US009291430B2

(12) United States Patent
Clark

(10) Patent No.: US 9,291,430 B2
(45) Date of Patent: Mar. 22, 2016

(54) ACCESSORY DEVICE FOR ATTACHMENT TO A FIREARM

(71) Applicant: Specialized Tactical Systems, Pleasant View, UT (US)

(72) Inventor: Robert Campbell Clark, Pleasant View, UT (US)

(73) Assignee: SPECIALIZED TACTICAL SYSTEMS, Pleasant View, UT (US)

( * ) Notice: Subject to any disclaimer, the term of this patent is extended or adjusted under 35 U.S.C. 154(b) by 170 days.

(21) Appl. No.: 13/626,646

(22) Filed: Sep. 25, 2012

(65) Prior Publication Data

US 2014/0082991 A1 Mar. 27, 2014

(51) Int. Cl.

| | |
|---|---|
| ***F41G 1/00*** | (2006.01) |
| ***F41G 11/00*** | (2006.01) |
| ***F41G 1/35*** | (2006.01) |

(52) U.S. Cl.

CPC . *F41G 11/00* (2013.01); *F41G 1/35* (2013.01)

(58) Field of Classification Search

CPC ..... F41G 1/35; F41G 11/00
USPC ..... 42/85, 90, 114–115, 124–125, 42/138–139, 146; 362/110, 113–114
See application file for complete search history.

(56) References Cited

U.S. PATENT DOCUMENTS

| | | | | |
|---|---|---|---|---|
| 2,529,801 | A * | 11/1950 | Fisk | 42/128 |
| 5,400,008 | A * | 3/1995 | Toohey | 340/321 |
| 6,685,067 | B2 * | 2/2004 | French | 224/198 |
| 6,953,259 | B2 * | 10/2005 | Parsons et al. | 362/191 |
| 7,845,105 | B1 | 12/2010 | Cahill | |
| 8,166,694 | B2 * | 5/2012 | Swan | 42/90 |
| 8,403,515 | B2 * | 3/2013 | Eichelberger et al. | 362/106 |
| 2006/0026882 | A1 | 2/2006 | Miller et al. | |
| 2008/0168696 | A1 | 7/2008 | Orne et al. | |
| 2009/0283558 | A1 | 11/2009 | Wanzer | |
| 2009/0288328 | A1 | 11/2009 | Kiser | |
| 2009/0293334 | A1 * | 12/2009 | Swan | 42/90 |
| 2010/0005697 | A1 | 1/2010 | Fluhr et al. | |
| 2010/0229450 | A1 | 9/2010 | Becker et al. | |
| 2010/0315256 | A1 | 12/2010 | Hughes et al. | |
| 2011/0146128 | A1 | 6/2011 | Haering | |
| 2011/0219657 | A1 | 9/2011 | Ash, Jr. et al. | |
| 2012/0055062 | A1 * | 3/2012 | Mironichev et al. | 42/85 |
| 2012/0057360 | A1 | 3/2012 | Swan | |

* cited by examiner

*Primary Examiner* — Stephen M. Johnson
*Assistant Examiner* — Benjamin Gomberg
(74) *Attorney, Agent, or Firm* — Brian J. Riddle; Fabian Vancott

(57) ABSTRACT

An accessory device for attachment to a firearm may include a device body having a light source and a biasing member extending from the device body through an aperture of a rail clip. The biasing member has a distal end shaped for insertion into a firearm slot, and the device body has an anti-rotation feature that prevents the body from rotating about the biasing member with respect to the rail clip when the distal end is inserted in the firearm slot.

17 Claims, 6 Drawing Sheets

ACCESSORY DEVICE FOR ATTACHMENT TO A FIREARM

BACKGROUND

Some types of firearms include a flashlight that functions as a spotlight for illuminating remote targets. These lights are rigidly mounted and direct light along the firearm's barrel and in the direction of the target of the firearm. Many firearms may be equipped with a rail, sometimes referred to as a Picatinny rail, which is generally mounted along the weapons barrel. Such a rail provides a place to attach accessory devices to the firearm, such as spotlights.

BRIEF DESCRIPTION OF THE DRAWINGS

The accompanying drawings illustrate various examples of the principles described herein and are a part of the specification. The illustrated examples are merely examples and do not limit the scope of the claims.

DETAILED DESCRIPTION

Although a spotlight may be useful in some circumstances, any attachment to the firearm adds weight. Powerful spotlights often use larger, and therefore, heavier batteries. The additional weight on the end of a firearm reduces the firearm's mobility, which increases the firearm operator's time and energy to operate the firearm.

Furthermore, a bright light in a dark or dimly lit environment has the side effect of causing temporary blindness, if shone in the eyes. Although this may be a desirable effect on an enemy, this may result in a life threatening situation for a friend. Additionally, a spotlight has the unwanted effect of broadcasting the operator's position. In this situation, the firearm operator may use a navigational light that allows him to see what is in his immediate vicinity rather than a distantly focused spotlight.

The principles described herein include an accessory device for attachment to a firearm. Such a device may include a device body having a light source and a biasing member extending from the device body through an aperture of a rail clip. The biasing member has a distal end shaped for insertion into a firearm slot, and the device body has an anti-rotation feature that prevents the body from rotating about the biasing member with respect to the rail clip when the distal end is inserted in the firearm slot.

In the following description, for purposes of explanation, numerous specific details are set forth in order to provide a thorough understanding of the present systems and methods. It will be apparent, however, to one skilled in the art that the present systems and methods may be practiced without these specific details. Reference in the specification to "an example" or similar language means that a particular feature, structure, or characteristic described in connection with the example is included in at least that one example, but not necessarily in other examples. The various instances of the phrase "in one example" or similar phrases in various places in the specification are not necessarily all referring to the same example.

Figure 1:
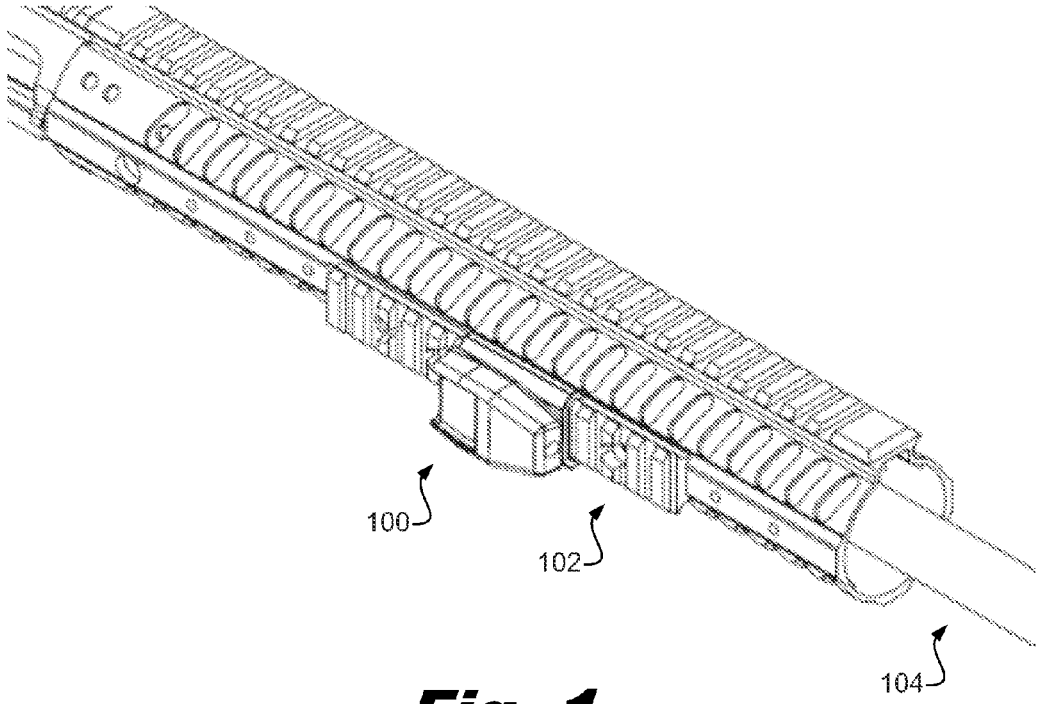
FIG. 1 is a diagram of an accessory device attached to a rail, according to principle described herein.

FIG. 1 is a diagram of an accessory device (100) attached to a rail, according to principle described herein. In this example, the accessory device (100) is attached to rail (102) of firearm (104). In some examples, the rail (102) is a Picatinny tactical rail developed and sold by Picatinny Arsenal. The accessory device (100) may include a light source, such as a light emitting diode (LED), which may be adjusted to direct light in any direction. In some examples, the accessory device (100) is freely rotatable for a full 360 degrees. In such an example, the accessory device may be adjusted to direct light towards a firearm operator's target or in another direction, such as towards the firearm operator's feet.

In one example, the light source may have a small battery that provides a low level of light to the operator. A low level of light may be desirable in some situations, such as special weapon and tactic (SWAT) operations or military operations where a brighter light may give away the firearm operator's location to enemies. A low level light may help the firearm operator maneuver around hard to see obstacles, traverse stairs, or stay within a desired area. In such situations, the firearm operator may desire the light to be directed at his feet or angled ahead of him. For safety reasons, the firearm operator may desire to direct his light forward while the firearm is pointed downward. The principles described herein may allow the firearm operator to position the accessory device in any direction about 360 degrees as desired.

The light source is constructed to emit a low level of light that illuminates just the operator's surrounding, but may not be readily visible at a distance. This may help conceal the operator's location from hostile observers white also providing a relatively low level of power consumption with a light weight accessory device (100).

Additionally, the light source may be adjusted with a tool-free mounting and adjustment system. The accessory device (100) may be capable of sliding forward and/or backward on, as well as added to or removed from, the rail (102) with a single hand. Further, the light may be adjusted to point nearly anywhere due to its ability to rotate 360 degrees.

In some examples, the rail (102) has the ability to attach to a variety of firearms such as, for example, shotguns, sniper rifles, hunting rifles, handguns, other firearms, or combinations thereof. In another example, the rail (102) may be attached to any item including items other than firearms such as, for example, a helmet. In this example, the accessory device (100) may be attached to the rail (102) that is attached to any type of these non-firearm items. In this manner, the accessory device (100) may be used in conjunction with non-firearm items for purposes or functions other than those associated with the firearms example disclosed herein.

In the example of FIG. 1, the firearm (104) is equipped with multiple Picatinny rails. Because the accessory device (100) may be attached to any one of these rails, the firearm operator may use one or multiple accessory devices (100) in a variety of ways. By way of example, if the firearm operator is in a stair well and wants to see his feet as well the stairs ahead of him, the operator may use multiple accessory devices (100) with different accessory devices directing light in different directions. When having a navigation light is desirable to the firearm operator, the firearm operator may use multiple accessory devices (100) where at least one of the accessory devices serves as backup.

While the example of FIG. 1 has an accessory device with a light source, other examples may include accessory devices with other features. For example, a non-exhaustive list of accessory devices includes a scope, an infrared sensor, a navigation device, a communication device, other features, or combinations thereof.

Figure 2:
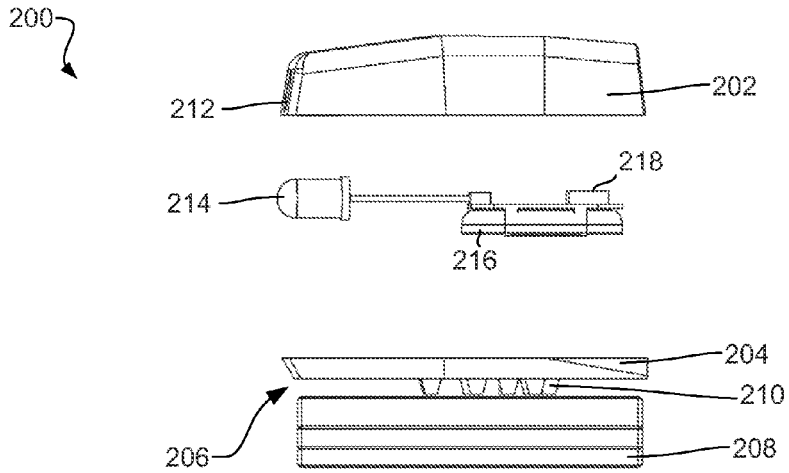
FIG. 2 is an exploded diagram of an accessory device, according to principles described herein.

FIG. 2 is an exploded diagram of an accessory device according to principles described herein. The accessory device (200) may have an upper housing (202) and a tower housing (204). An underside (206) of the lower housing (204) may be connected to a clip (208) that is shaped to slidably attach to the firearm's rail. In some examples, the clip (208) is attachable to another portion of the firearm, such as a firearm barrel.

The underside (206) may have multiple protrusions (210) extending towards the clip (208). These protrusions (210) may prevent the accessory device (200) from rotating when the protrusions (210) are engaged in recesses of the clip (208) as will be described in more detail below.

An opening (212) located in the front of the upper housing (202) may be large enough to accommodate a light source (214). The light source (214) may be an LED incandescent bulb, a plasma power source, a laser, other light sources, or combinations thereof. In one example, the light source (214) may produce light comprising varying wavelengths including, for example, blue, red, or other wavelengths. In another example, the light source (214) may produce white light. In still another example, the light source (214) may produce wavelengths of light outside of the visible spectrum, such as, for example, infrared wavelengths. In the example of FIG. 2, the light source is located between the upper and lower housings (202, 204) toward a front of the accessory device (200). A power source (216) may be located proximate a rear of the accessory device. The power source (216) may be a disposable battery, a rechargeable battery, another type of battery, or combinations thereof. In some examples, the accessory device (200) has multiple powers sources. The power source (216) may be connected to the light source (214) with a push button style on/off switch (218), another type of switch, or combinations thereof.

Figure 3:
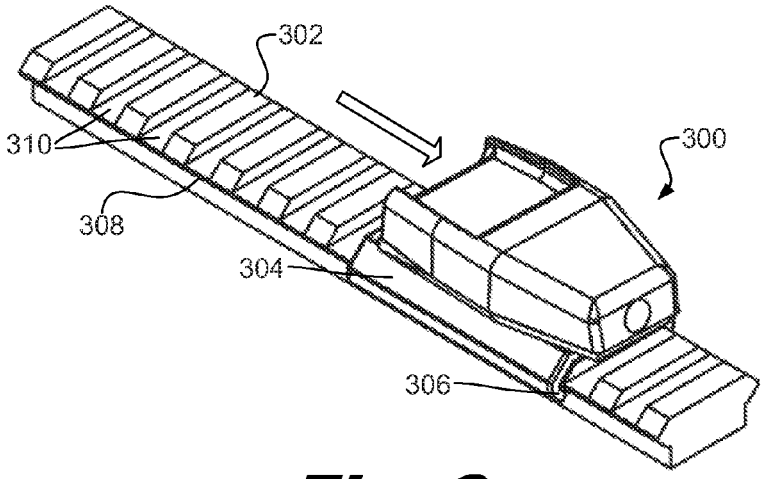
FIG. 3 is a diagram of an accessory device attached to a rail, according to the principles described herein.

FIG. 3 is a diagram of an accessory device (300) attached to a rail (302) according to the principles described herein. In this example, the accessory device (300) is slidably attached to a rail (302). In this example, the clip (304) of the accessory device (300) has inward facing edges (306) that hook into an undercut (308) or underside of the rail (302). The accessory device (300) may be secured to or removed from the rail (302) by sliding the clip (304) over or off of the rail's end (308). In some examples, the inward facing edges (306) of the clip (304) are compliant enough to snap the clip (304) over the edges of the rail (402).

In the example of FIG. 3, the rail (302) has multiple slots (310) formed across the rail's width. A biasing member, which wilt be described in more detail below and located on an underside of the accessory device (300), may be released such that a distal end of the biasing member extends into one of the slots (310). In such a manner, the released biasing member may lock the accessory device along the length of the rail (302).

Adding accessory devices increases the utility of the firearm with the trade off of decreasing the firearm's mobility. The added weight of the accessory device makes for a heavier firearm. It also increases the amount of time and effort needed to move the firearm to point as well as to stop the firearm when the target is acquired. In this example, the relatively small size of the accessory device (300) is approximately the width of the rail (302). Furthermore, the accessory device (300) is relatively thin. As a result, the accessory device (300) may add a minimal amount of weight and, thus, increase the utility of the weapon without significantly lessening the firearm's mobility. Additionally, the accessory device's small size does not obstruct the firearm operator's field of view.

Figure 4:
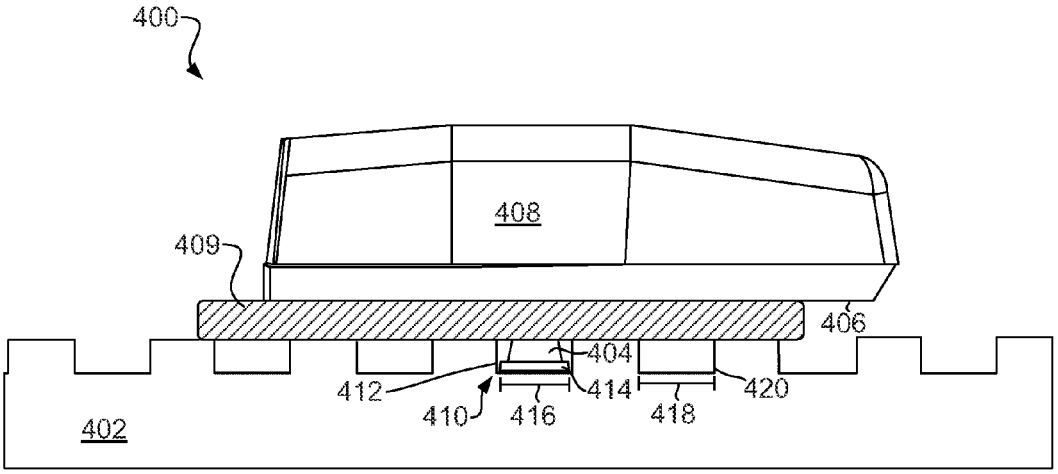
FIG. 4 is a side diagram of an accessory device attached to a rail, according to the principles described herein.

FIG. 4 is a side diagram of an accessory device (400) attached to a rail (402) according to the principles described herein. In this example, the accessory device (400) is locked in place along a length of the rail (402). A biasing member (404) attached to the underside (406) of the accessory device's body (408) extends through an aperture of the clip (409). The biasing member (404) has a mechanism that generates a biasing force that pushes a distal end (410) of the biasing member (404) into a slot (412) of the rail (402). The mechanism may include a spring, a compression spring, a tension spring, a wave spring, hydraulics, a feature that generates hoop tension, another feature that generates a biasing force, or combinations thereof.

A flange (414) may be attached to the distal end (410) of the biasing member (404). A width (416) of the flange may be approximately the width (418) of the slots (412). In some examples, the flange width (416) is slightly less than the slot width (418) to easily accommodate the insertion of the distal end (410), but leaving little room for the distal end (410) to slide within the slot (412). In other examples, the flange's width is slightly larger than the slot's width (412) and the biasing force is strong enough to overcome the friction between the flange and the slot's side walls to insert the distal end (410) into the slot (412). In such an example, the biasing member (404) may be rigidly attached in place within the slot (412), which may reduce and/or eliminate the distal end (410) from sliding within the slot (412). In some examples, the flange (414) and/or slot's wall (420) are tapered to cause a wedging force that tightly secures the biasing member (404) within the slot (412). In alternative examples, the distal end (410) snaps into a feature of the slot (412) to hold the biasing member (404) in place.

In some examples, the biasing force is sufficient to ensure that the biasing member (404) is inserted into the slot. In other examples, the biasing force is strong enough to lift the clip (409) such that the inward facing edges of the clip (409) hook an underside or undercut of the rail (402) and the friction between generated thereby contribute to holding the accessory device (400) firmly in place. In some examples, the rail (402) has no slots, but the friction provided by the biasing force between a top surface of the rail and the distal end (410) and between the inward facing edges and underside of the rail is sufficient to firmly secure the accessory device (400) at the selected location along the length of the rail.

The biasing force may also pull the underside (406) of the accessory device's body (408) up against the clip (409). As a result, for those examples that have protrusions extending from the body's underside (406), the protrusions will securely interlock with the recesses (206) in the clip (409) and, thus, lock the orientation of the accessory device (400).

To retract the biasing member (404) from the slot (412), a firearm operator may pull on the body (408) of the accessory device (400). As the body (408) moves in a direction away from the rail (402), the biasing force may be overcome, and the biasing member (404) may move with the body (408). The flange (414) may be wider than the aperture in the clip (409) and thereby prevent the biasing member (404) from completely moving out of the aperture. Thus, the firearm operator may pull on the body (408) until the flange (414) hooks the underside of the clip (409). When the biasing member (404) is pulled out of the slot (412), the firearm operator may slide the accessory device (400) along the length of the rail (402). In such an example, the firearm operator may adjust the position of the accessory device (400) or slide the accessory device (400) off of the rail (402) altogether.

Figure 5:
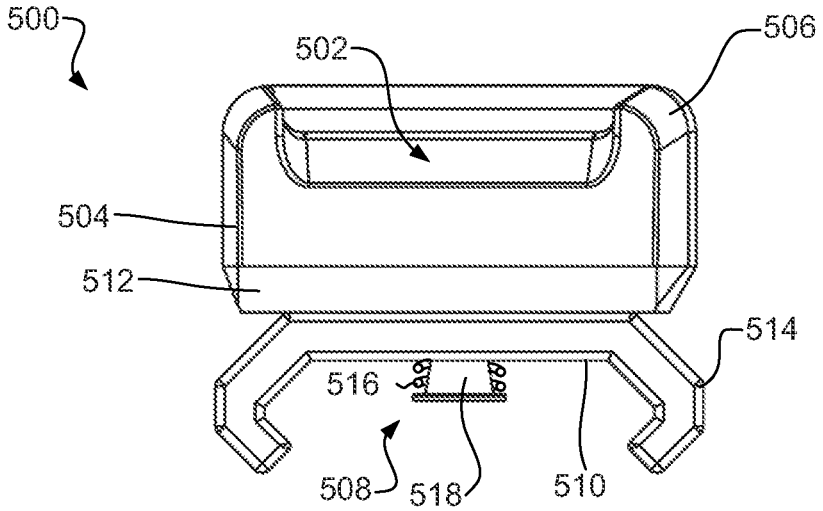
FIG. 5 is a diagram of an accessory device, according to the principles described herein.

FIG. 5 is a diagram of an accessory device (500) according to the principles described herein. In this example, the accessory device (500) is shown as it might appear looking down the barrel of a firearm. In some examples, a button (502) for turning the light source (214) on and off is located on the outside of the accessory device's body (504). In the example of FIG. 5, the button (502) is located on the upper housing (506) of the body (504), and the button (502) is slightly indented to protect the button (502) from any unwanted contact resulting in an unintended activation or deactivation of the light source (214).

The biasing member (508) may be located on the underside (510) of the lower housing (512) and protrude through an aperture of the clip (514). In the example of FIG. 5, a compression spring (516) surrounds a pin (518) of the biasing member (508). In the example of FIG. 5, the biasing force provided by the compression spring (516) pulls the accessory device's body (504) towards the clip (514).

Figure 6:
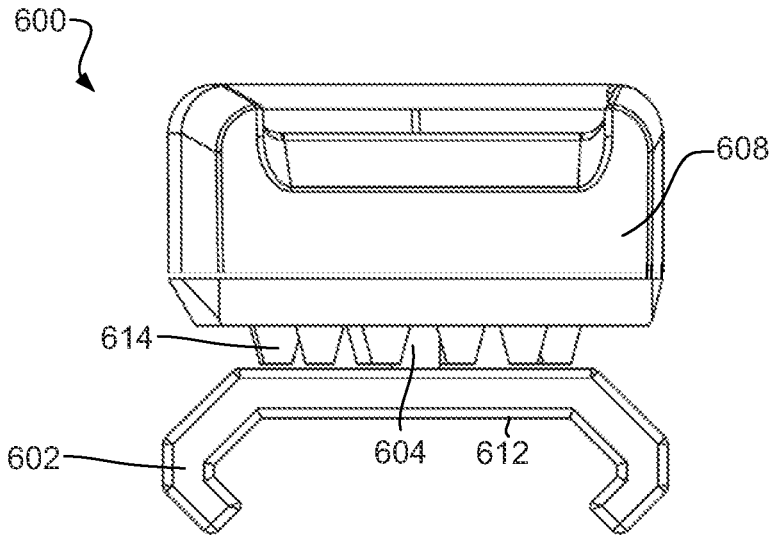
FIG. 6 is a diagram of an accessory device, according to the principles described herein.

FIG. 6 is a diagram of an accessory device (600) according to the principles described herein. The clip (602) of the accessory device (600) is shaped to slide onto a rail, similar to other Picatinny accessory devices. However, unlike other devices that are mounted using a cross bolt, an accessory device (600) in the example of FIG. 6 comprises a quick release system. When the accessory device (600) is secured at a desired location along a length of the rail, the pin (604) of the biasing member is fully extended. However, to install, move or remove the device, the operator may pull on the accessory device's body (608), causing the pin (604) to retract. In some examples, the aperture in the clip (602) within which the biasing member is partially disposed, is counter-sunk so that the flange sits flush with the clip's underside (612) when the accessory device's body (608) is pulled away at its maximum distance. With the pin (604) fully retracted, the operator is free to slide the accessory device (600) along the length of the rail because the protrusions (614) are also retracted from the recesses formed in the clip (602). With the protrusions (614) retracted, the accessory device (600) is free to swivel 360 degrees, about the pin. When the operator finds a desired location along the rail and a desired rotational position of the accessory device (600), the operator may release the body (608) and allow the biasing force to pull the accessory device's body (608) back towards the clip (602). As the body (608) moves back, the protrusions (614) may move back into the clip's recesses and the distal end of the biasing member may move back into the rail's slot. The adjustment may be made without tools, and may even be made without towering the firearm.

Figures 7A, 7B:
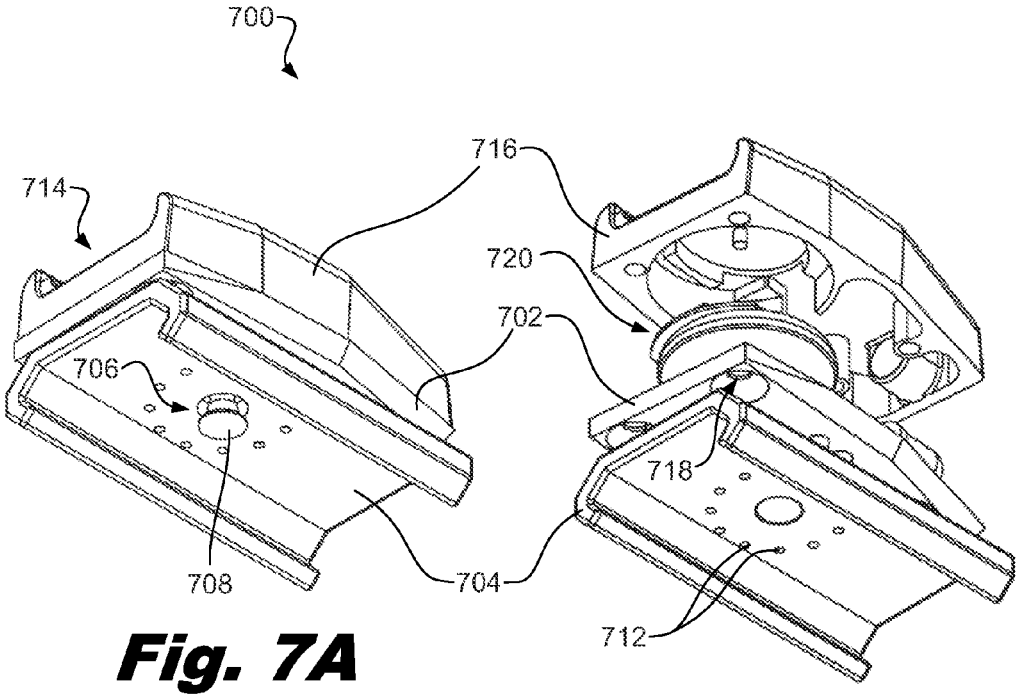
FIGS. 7A and 7B are diagrams of an accessory device, according to the principles described herein.

FIGS. 7A and 7B are diagrams of an accessory device (700) according to the principles described herein. In this example, the lower housing (702) is connected to the clip (704) with the biasing member (706). The flange (708) is attached to the distal end of the biasing member (706) to prevent the clip (704) from being completely separated from the lower housing (702). A spring is positioned around a pin of the biasing member (706) between the flange (708) and the clip (704) that provides a biasing force to pull the clip (704) and the lower housing (702) together. In the example of FIGS. 7A and 7B, multiple holes (712) are evenly spaced from each other and equidistant from the pin creating a circle. These holes receive the protrusions formed in the underside of the tower housing (702). When the accessory device's body (714) is pulled away from the clip (704), the protrusions are pulled out of the holes (712) allowing the housing to swivel freely about the biasing member. When the operator finds the desired position of the housing, the operator may release the housing allowing the protrusions to be pulled back into the holes (712).

The upper and lower housings (716, 702) are held together by four screws on the four corners of the housings (716, 702). Screw holes (718) are located on the underside of the lower housing (702) and may be accessed by rotating the body in either direction. In some examples, the screw holes (718) are counter-sunk, so the heads of the screws sit even or below the surface of the lower housing (702). This may create a smooth surface allowing the lower housing (702) to be flush against the clip (704).

With the screws (704) removed, the upper and tower housing (716, 702) may be separated, allowing easy access to the interior of the device (700). The underside of the upper housing (716) has multiple spaces formed to hold the components firmly place. Consequently, this may reduce and/or eliminate unnecessary hardware and, therefore, reduce weight. The upper housing (716) may also contain a button (720), that when pushed, activates the on/off switch to turn on or off the light source (214). In the example of FIGS. 7A and 7B, the surface area of the button (720) is greater than that of the switch (107), and the underside of the button (720) has a small pin that activates the switch.

Figure 8:
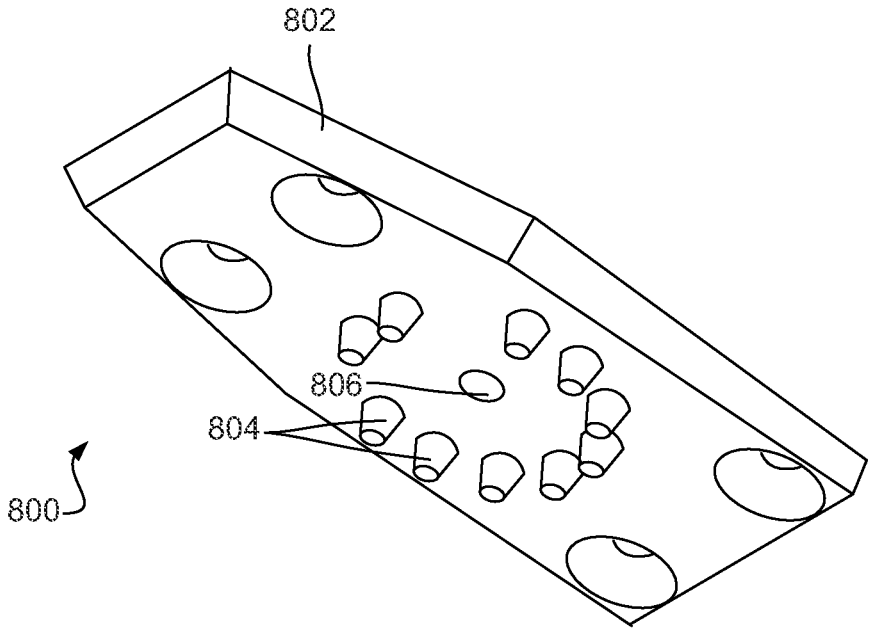
FIG. 8 is a diagram of an underside of an accessory device body, according to the principles described herein.

FIG. 8 is a diagram of an underside (800) of an accessory device body (802) according to the principles described herein. In this example, the underside (800) has multiple protrusions (804) that are shaped to fit within the recesses formed in the clip. In some examples, the protrusions (804) are tapered to help self align the accessory device body (802) as the clip and the body (802) come together. In some examples, the protrusions are evenly spaced with respect to each other and are equidistant from a hole (806) that accommodates the biasing member. However, the protrusions may be arranged in any order or arrangement. Further, while the example of FIG. 8 has multiple protrusions, the underside (800) may have any number of protrusions, including just a single protrusion. Further, the protrusions (804) may have any shape or size that allows the protrusions (804) to be inserted into the recesses of the clip.

Figure 9:
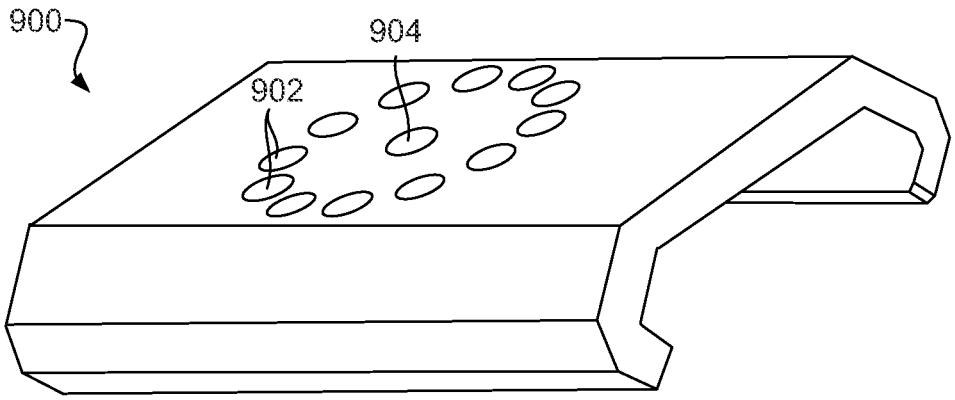
FIG. 9 is a diagram of a rail clip according to the principles described herein.

FIG. 9 is a diagram of a rail clip (900) according to the principles described herein. In this example, the rail clip (900) has multiple recesses (902) to receive the protrusions (804) of the accessory device body. In this example, the recesses form a complementary spacing and size pattern as the protrusions in the example of FIG. 8. For example, each of the recesses (902) may be equidistantly spaced from the aperture (904) that accommodates the biasing member. However, the recess pattern may include any arrangement of sizes and spacing that allows the recesses to receive the protrusions of the accessory device's body.

In some examples, the clip (900) has more recesses (902) than the body has of protrusions. In some examples, a single protrusion of the accessory body is orientated to fit into any of the multiple recesses. A single protrusion (804) may be sufficient to prevent the accessory device from rotating; however, multiple protrusions may reduce the load per protrusions in the event that a rotational force is applied to the accessory device.

The recesses (902) may be formed in slots, holes, dimples, through holes, indentation, other variations, of combinations thereof. In some examples, the recesses (902) are shaped to be wider than the protrusions. However, in some examples, the recesses (902) are sized such that a small compression fit is formed with the protrusions are inserted into the recesses. In some examples, the recesses and the protrusions are shaped such that the protrusions are snapped into the place when the accessory device body is moved into place.

Figure 10A:
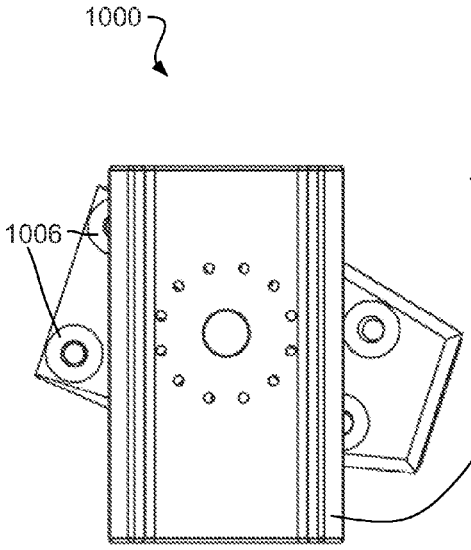
FIGS. 10A and 10B are diagrams of an accessory device body rotated into a second position, according to the principles described herein.
Figure 10B:
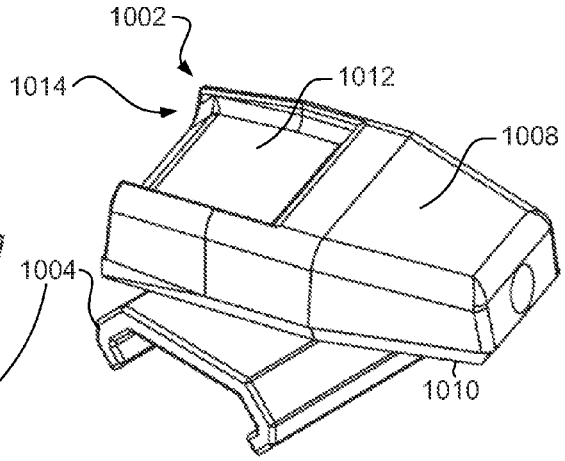

FIGS. 10A and 10B are diagrams of an accessory device body (1000) rotated into a second position (1002) according to the principles described herein. In this example, the accessory device body (1000) is rotated approximately 70 degrees from a central axis of the clip (1004). In some examples, the accessory device (1000) has the capability to rotate a full 360 degrees in either direction. When the accessory device (1000) is rotated, the bolts (1006) that secure the upper and lower body housings (1008, 1010) together are accessible. By adjusting the housings to accommodating angles, the bolts (1006) may be removed. When the bolts (1006) are removed, the upper housing (1008) may be removed and the inside of the device may be accessed.

In the example of FIGS. 10A and 10B, the button (1012) occupies nearly the entire rear half of the upper housing (1008). A large button may allow a firearm operator convenient access to the button (1012) which may be helpful when the firearm operator is in a dangerous situation. The indent (1014) formed in the upper housing (1008) may be used by the firearm operator as a guide leading his fingers to the button (1012).

In the example of FIGS. 10A and 10B, the light from the light source (1016) of the accessory device (1000) is directed in a different direction than the clip is oriented. As a result, in examples where a rail of the firearm is positioned such that it's central axis is substantially parallel to the firearm's barrel, the light source is directed in a direction that will be away from the firearm's target. Thus, the direction that the firearm is pointed and the light is pointed may be different.

Figure 11:
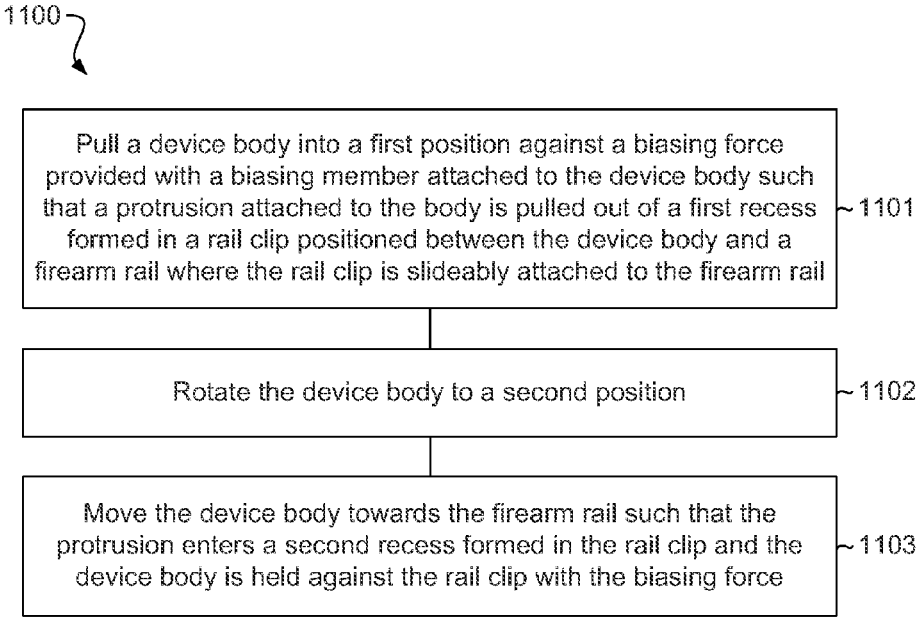
FIG. 11 is a flowchart of a method for adjusting a firearm accessory device, according to the principles described herein.

FIG. 11 is a flowchart of a method (1100) for adjusting a firearm accessory device according to the principles described herein. In this example, the method (1100) includes pulling (1101) a device body into a first (position against a biasing force provided with a biasing member attached to the device body such that a protrusion attached to the body is pulled out of the a first recess formed in a rail clip positioned between the device body and a firearm rail. The rail clip is slideably attached to the firearm rail; rotating (1102) the device body to a second position; and moving (1103) the device body towards the firearm rail such that the protrusion enters a second recess formed in the rail clip and the device body is held against the rail clip with the biasing force.

In some examples, the biasing member is a spring loaded member with a distal end shaped for insertion into a slot of the firearm rail. The device body may also contain a light source, which may be a LED. In some examples, the second position directs light from the tight source in a direction that is away from a target of the firearm to which the firearm rail is attached.

The accessory device may be made of any material that is compatible with the principles described herein. A wide range of materials suitable for the tight may include aluminum, plastic, carbon fiber, other materials, or combinations thereof. More than one material may be used. For example, the upper and lower housings may be made with carbon fiber while the clip is made of aluminum.

While the examples above have been described with specific anti-rotation features, any anti-rotation feature may be used. For example, the anti-rotation feature may be at least one protrusion spaced to be received into a recess of a clip. In other examples, the anti-rotation feature of the accessory device is a recess spaced to receive a protrusion of the clip. The protrusion or recesses may be any shape or size that allows it to interlock with a feature of the clip to prevent rotation. In some example, the anti-rotation feature is a surface that provides enough friction to prevent the body from rotating with respect to the clip when the biasing member's distal end is in the slot. In other examples, magnets embedded in the clip and the underside of the accessory body are used to prevent rotation.

Further, while the examples above have been described with the accessory device body being freely rotatable with the ability to rotate a full 360 degrees, a smaller rotational range is also compatible with the principles described herein. For example, the device body may be limited to rotating less than 360 degrees, such as being limited to 270 degrees or less.

The preceding description has been presented only to illustrate and describe examples and examples of the principles described. This description is not intended to be exhaustive or to limit these principles to any precise form disclosed. Many modifications and variations are possible in light of the above teaching.

What is claimed is:

1. An accessory device, comprising:

a rail clip to slidably couple with a rail, the rail clip comprising a number of recesses defined therein;

a device body coupled to the rail clip, the device body comprising:

a number of protrusions, the protrusions dimensioned to engage with the number of recesses defined within the rail clip; and a biasing member comprising:

a pin extending from the device body through an aperture of the rail clip; and a biasing spring to engage with a slot of the rail;

wherein the device body is freely rotatable at least 360 degrees about the biasing member perpendicular to a length of the rail when a biasing force of the biasing spring is overcome enough to disengage the protrusions from the recesses, wherein the pin engages with the slot, of the rail when the biasing spring simultaneously biases the device body towards the rail clip, wherein pulling the device body against the biasing force provided by the biasing spring simultaneously causes the protrusions to disengage from the recesses, the pin to disengage from the rail slot, and the rail clip to slide along a length of the firearm rail, and wherein the biasing member snaps into a feature defined within the rail slot.

2. The device of claim 1, wherein a distal end of said biasing member comprises a flange with a flange width approximately equal to a slot width of said slot.

3. The device of claim 1, wherein said number of protrusions comprise at least one protrusion formed in an underside of said device body, said at least one protrusion being shaped for insertion into said number of recesses defined within said rail clip.

4. The device of claim 1, wherein said device body comprises an upper housing, a lower housing, and a light source, wherein said light source is positioned between the upper housing and the lower housing, and wherein said biasing member extends from an underside of said lower housing.

5. The device of claim 4, wherein said light source is a light emitting diode.

6. The device of claim 1, wherein said rail clip is shaped for slidable attachment to a firearm rail.

7. The device of claim 1, in which said protrusions prevent said device body from rotating about said biasing member with respect to said rail clip when said protrusions are engaged with said recesses.

8. The device of claim 1, wherein said rail is a Picatinny tactical rail.

9. The device of claim 1, wherein the number of recesses is greater than the number of protrusions.

10. A device for attachment to a rail, comprising:

a spring loaded member extending from a device body through an aperture of a rail clip, the spring loaded member comprising:

a pin extending from the device body through the aperture of the rail clip;

a biasing spring surrounding the pin, the biasing spring biased to engage the pin with a slot of the rail;

wherein the pin comprises a distal end shaped for insertion into a rail slot of the rail; and a rail clip coupled to the device body via the spring loaded member to couple the device to the rail, the rail clip comprising a number of recesses defined therein; and a number of protrusions formed in the device body, the protrusions dimensioned to engage with the number of recesses defined within the rail clip, wherein said protrusions prevent said device body from rotating about said spring loaded member when said protrusions are engaged with said recesses;

wherein the rail clip is slidably coupled to a rail, wherein the pin engages with a rail slot when the compression spring simultaneously biases the device body towards the rail clip, wherein pulling the device body against a biasing force provided by the spring loaded member simultaneously causes the protrusions to disengage from the recesses, the spring loaded member to disengage with the rail slot, and the rail clip to be slidable along a length of the rail and, at the same time, the device body to be freely rotatable through more than 360 degrees about an axis that passes through the spring loaded member and is perpendicular to the length of the rail, and wherein the spring loaded member snaps into a feature defined within the rail slot.

11. The device of claim 10, wherein said device body comprises a light emitting diode.

12. The device of claim 11, wherein said protrusions are spaced to orient said device body such that said light emitting diode directs light in a direction that is non-parallel with respect to an orientation of a barrel of a firearm to which the device is coupled.

13. The device of claim 11, wherein said protrusions are spaced to orient said device body such that said light emitting diode directs light in a direction that is parallel with respect to an orientation of the rail clip.

14. The device of claim 10, wherein said device body is freely rotatable about said spring loaded member when said protrusions are disengaged with said rail clip.

15. The device of claim 10, wherein said distal end comprises a flange with a flange width approximately equal to a slot width of said rail slot.

16. The device of claim 10, wherein said device body is freely rotatable greater than 360 degrees in both a clockwise and counter-clockwise direction about said spring loaded member.

17. A firearm accessory system comprising:

a device body comprising:

a pin extending from the device body;

a compression spring surrounding the pin; and a number of protrusions extending from the device body; and a rail clip to couple with a rail, the rail clip comprising a number of recesses defined therein, wherein the protrusions are dimensioned to engage with the recesses, wherein the device body is coupled to the rail clip via the pin, the pin extending through an aperture defined in the rail clip, wherein the compression spring simultaneously biases the device body towards the rail clip such that the pin is biased to extend past the rail clip and biases the protrusions to engage with the recesses, wherein the pin engages with a rail slot when the compression spring simultaneously biases the device body towards the rail clip, wherein the rail clip is slidably coupled to a firearm rail, wherein pulling the device body against a biasing force provided by the compression spring simultaneously causes the protrusions to disengage from the recesses, the pin to disengage from the rail slot, and the rail clip to slide along a length of the firearm rail, and wherein the pin snaps into a feature defined within the rail slot.

* * * * *